United States Patent [19]

Watanabe et al.

[11] 4,040,434

[45] Aug. 9, 1977

[54] DEVICE FOR DETECTING STACK OF COINS FOR USE IN COINS-PACKAGING MACHINE

[75] Inventors: Kenkichi Watanabe, Kawasaki; Kyoichi Ohsako, Tokyo, both of Japan

[73] Assignee: Laurel Bank Machine Co., Ltd., Tokyo, Japan

[21] Appl. No.: 687,224

[22] Filed: May 17, 1976

[30] Foreign Application Priority Data

June 6, 1975 Japan ..... 50-68309

[51] Int. Cl.[2] ..... G07D 9/00

[52] U.S. Cl. ..... 133/1 A

[58] Field of Search ..... 133/1 A, 1 R, 8 A; 340/280; 53/254

[56] References Cited

U.S. PATENT DOCUMENTS

| | | | |
|---|---|---|---|
| 1,710,086 | 4/1929 | Downey | 133/1 R |
| 2,680,444 | 6/1954 | Grant | 133/1 R |

*Primary Examiner*—Allen N. Knowles
*Attorney, Agent, or Firm*—Harold L. Stowell

[57] ABSTRACT

A device for detecting stacks of coins for use in a coins-packaging machine adapted to wrap each stack of a predetermined number of coins with wrapping paper, said device comprising a stacking cylinder of an electrically insulating material for receiving coins supplied through the upper inlet thereof and stacking the coins thus supplied face to face relation each other to form therein a stack of predetermined number of coins, an electrically conductive bottom plate disposed adjacent the lower open end of said stacking cylinder and adapted to support the stack of coins from the lower end and be removed therefrom for enabling the stack of coins to be discharged from the stacking cylinder into the next stage for wrapping, an electrode of cylindrical shape formed as part of inner wall of said stacking cylinder at a height of a little more distance than the height of said stack of coins from the lower end thereof, a relay and an electric power source therefor connected in series relation between said electrode and said bottom plate, whereby, when at least one coin of said stack is incorrectly positioned and the height thereof increases into contact with said electrode, electric current may flow through said stuck coins so that said relay may be energized to produce an output for detecting the incorrect stack condition of coins within said stacking cylinder.

5 Claims, 2 Drawing Figures

DEVICE FOR DETECTING STACK OF COINS FOR USE IN COINS-PACKAGING MACHINE

BACKGROUND OF THE INVENTION

The present invention relates to a device for detecting incorrect stacking condition of coins having been charged within a stacking cylinder of a coins-packaging machine.

In one form of the prior art of such device, there is provided a detecting rod means axially slidably mounted in the stacking cylinder, said rod means being adapted to be axially moved to a desired level along said cylinder when a predetermined number of coins have been charged and detect whether or not the coins tacking incorrect positions in said cylinder through the positions in said cylinder through the examination for the presence of contact between said rod means and said coins.

In another form of the prior art of a device of this type, there are provided in the stacking cylinder a pair of upper and lower holding rods adapted to hold the stack of coins therebetween and carry the stack of coins out of said cylinder into the next stage for wrapping, wherein, when there exists at least one coin incorrectly positioned in said cylinder and said upper holding rod excessively moves downwardly, such incorrect stacking condition is possibly detected by turning on a switch means to operate a control device by such excessive movement of said holding rod.

In such devices of prior art as above mentioned, it is required to provide mechanisms for vertically moving the rod means and for driving movable elements cooperative with the rod means and, therefore, the detecting device of the prior art has been much complex in its construction and had a tendency to be sometimes out of order due to dust and dirt stuck therein and become of less durability.

SUMMARY OF THE INVENTION

The present invention aims to provide an improved device for detecting a stack of coins for use in a coins-packaging machine which is free from the above mentioned drawbacks of the prior art.

According to the present invention there is provided a device for detecting a stack of coins for use in a coins packaging machine comprising a stacking cylinder of electrically insulating material having an electrode disposed as part of inner cylindrical surface thereof at a height of a little more distance than the height of the stack of coins from the lower end thereof, and an electrically conductive bottom plate disposed at the lower open end of said insulating cylinder for supporting the bottom of said stack of coins, said electrode and said bottom plate being electrically connected through electric wire having therein a relay and an electrical energy source therefor.

Accordingly, in case of the predetermined number of coins are all correctly stuck to form a required stack of coins in which each coin is positioned in face to face relation with the next one, the height of the stack is kept minimum and do not reach said electrode thereby to remain uncontacted therewith. Thus the stack of coins fails to close the electric circuit and no electric current passes through said relay so that the coins packaging machine normally operates and continues to successively package the coins in a proper cyclic manner. In other words, when the predetermined number of coins have been charged in the stacking cylinder, said bottom plate is timely moved for enabling the stack to be discharged downwardly into the next stage for packaging. After that the bottom plate is again moved to close the lower open end of said stacking cylinder and complete one cyclic operation of the machine.

However, in case of one or more coins being incorrectly positioned in a stack of predetermined number of coins in the stacking cylinder in which one or more coins take upright or inclined positions, the height of the stack increases in an amount to be contacted to said electrode thus closing the electric circuit through the conductivity of said stack of coins. Therefore, said relay is energized by said electrical power source to produce an output by which the operation of the machine is ceased or automatically reset to start another cycle for taking a suitable action.

According to a device for detecting stack of coins of the present invention, it may be eliminated to provide any adjustably movable mechanisms of considerable complex constructions such as those of the prior art. Further, in the present invention, since no mechanical movable member to be actuated is required at all it is possible to obtain a highly improved detecting device of the kind which is much more durable and reliable than the prior art.

DESCRIPTION OF PREFERRED EMBODIMENTS

Preferred embodiments of the present invention will now be described in detail hereinbelow with reference to the drawings.

Figure 1:
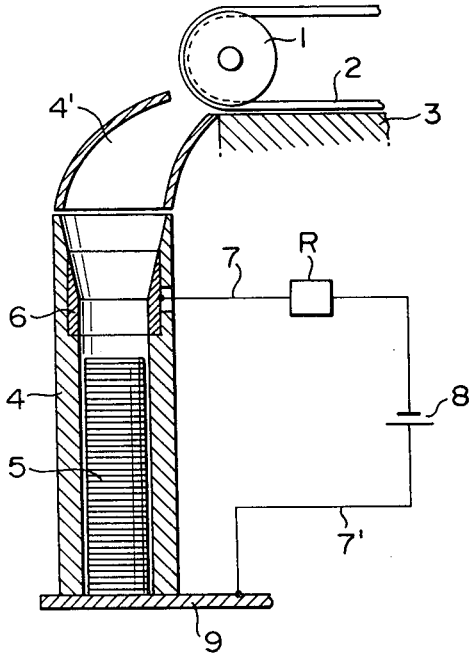
FIG. 1 is a diagrammatic sectional view of a device for detecting a stack of coins for use in a coins packaging machine in accordance with the present invention particularly showing that all coins take correct positions in a stacking cylinder.
Figure 2:
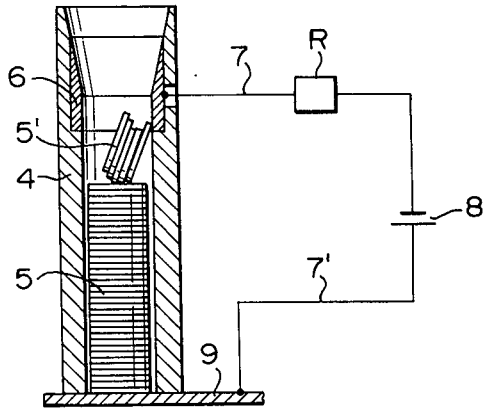
FIG. 2 is a diagrammatic sectional view of the device of FIG. 1 but showing that several coins take incorrect positions within said stacking cylinder.

In a coins-packaging machine as shown in FIGS. 1 and 2, a number of coins having been fed in line by a rotary disc (not shown) are being successively conveyed along a conveyor belt 2 entrained in tension over a drive wheel 1 and after that these coins are transferred through a chute 4' into a stacking cylinder 4 disposed at the forward end of a passageway 3 for said coins.

Is disposed adjacent the side of said conveyor belt 2 a star gear wheel (not shown) which is driven by the coins successively conveyed along said belt and enables a calculating machine (not shown) to calculate the number of coins passed therethrough into the stacking cylinder 4. When the number of coins having supplied into the stacking cylinder 4 amounts to a predetermined number, the rotation of said drive wheel 1 is automatically stopped thereby to form a stack of coins 5 in which each coin is stuck in face to face relation with the next one as shown in FIG. 1.

Said stacking cylinder 4 is made of a suitable electrically insulating material over its entirety or over at least partial inner wall surface to which the stack of coins correctly positioned possibly be contaced. In the upper innerwall portion of the stacking cylinder 4, there is provided a cylindrical wall of electrode 6 at the height of a little more distance than the height of the stack of coins from the lower end of said stacking cylinder.

Since the height of the stack of coins should vary in accordance with the kind of coins and the number of coins stuck in said stacking cylinder 4, the level of said electrode 6 is selectively determined with reference to these factors in the manner that said electrode 6 be positioned at a level of a little more distance than the height of the subject stack from the lower end of said stacking cylinder 4 when each of the coins of the subject stack is correctly positioned. Namely, when the predetermined number of coins are all stuck in correct positions in which each coin is horizontally positioned in face to face relation with the next one, a required space shall be maintained between the electrode 6 and the stack of coins 5 so as to prevent contact therebetween.

There is arranged a bottom plate 9 downwardly adjacent to the lower open end of said stacking cylinder 4, said bottom plate being made of a suitable electrically conductive material and adapted to support said stack of coins from its lower end while being in closed position. Said bottom plate may be so operative as to move into a open position when the predetermined number of coins are all correctly positioned as the stack within said stacking cylinder 4, so that the stack of coins may be dischared into the next station for packaging stage.

An electric wire 7 is joined to said electrode 6 and led out therefrom to an electric power source 8 via a relay R. An other electric wire 7' is joined to said bottom plate 9 and led out therefrom to the other terminal of said electric power source 8. These elements of an electric circuit are constituting a detecting circuit for the device of the present invention.

A device for detecting a stack of coins according to the present invention is given such construction as above set forth, and accordingly may be obtained the operations as described hereunder.

In the case that all the coin of the stack of the predetermined number of coins are correctly positioned within said stacking cylinder in which each coin be horizontally positioned in face to face relation with the next one after these coins have been fed through said chute 4', said stack of coins 5 remains uncontacted with said electrode 6 since the desired space may be maintained therebetween as above described with reference to FIG. 1. Accordingly, no electric current is caused to pass through said detecting circuit so that said relay remains unoperative and no output is produced therefrom. Therefore, the coins-packaging machine will normally continue its specific cyclic operations in which the respective stacks of the predetermined number of coins may be packaged in successive manner.

In the case one or more coins of the predetermined number of coins are given incorrect positions such as upright or inclined positions 5' in said stacking cylinder as shown in FIG. 2, the stack of coins is increased in its height and caused to be contacted to said electrode 6. Accordingly, said detecting circuit may be closed by the electrically conductive stack of coins and electric current may pass through said electric power source, said electric wire 7', said bottom plate 9, said stack of coins, said electrode 6, said electric wire 7 and said relay R, so that said relay may be energized to produce an output by which is performed a suitable countermeasure operation such as, for example, stopping of the machine operation, removing of the stack of coins including at least one uncorrectly positioned one from said stacking cylinder by automatically moving said bottom plate 9 to an open position, or resetting the coins-packaging machine to the initial condition of the cyclic operation.

In accordance with the present invention as above mentioned, there could be obtained, as compared with the prior art, a much more simple construction of a device for detecting a stack of coins wherein no member for mechanical movement is comprised. Therefore, the present invention could provide an improved device of the kind with much more durability and reliability than the prior art.

We claim:

1. A device for detecting a stack of coins for use in a coin-packaging machine adapted to form a stack of a predetermined number of coins in which each coin be horizontally positioned in face to face relation with the next one and then to package said each stack with wrapping material, said device comprising a stacking cylinder of electrically insulating material adapted to receive coins supplied from the upper inlet to form a stack of a predetermined number of coins therewithin, a bottom plate of electrically conductive material adapted to be moved between open and closed positions for discharging said stack of coins through the lower open end of said stacking cylinder into the subsequent stage of the packaging machine while in the open position and for supporting said stack of coins formed within said stacking cylinder from the lower end thereof, an electrode of a ring-like shape which forms part of the inner surface of said stacking cylinder at a height of a little more distance than the height of said stack of coins from the lower end thereof, a relay and an electric power source electrically connected together in series relation between said electrode and said bottom plate, whereby, when at least one coin is incorrectly positioned in said stacking cylinder and the height of said stack increases to get contact with said electrode, electric current is caused to pass through said relay via said stack of coins so that said relay may be energized to produce an output for detection of said incorrect position of said stack of coins within said stacking cylinder.

2. A device for detecting a stack of coins for use in a coin-packaging machine of claim 1, wherein said stacking cylinder is partially made of electrically insulating material over at least the sectional area of the inner cylindrical surface whose range in vertical direction corresponds to the overall height of said stack of the predetermined number of coins.

3. A device for detecting a stack of coins for use in a coin-packaging machine of claim 1, wherein, when said relay is energized to produce an output, the operation of said coins-packaging machine is stopped for enabling the countermeasure to be suitably carried out.

4. A device for detecting a stack of coins for use in a coin-packaging machine of claim 1, wherein, when said relay is energized to produce an output, said bottom plate may be moved to the open position in response to said output so as to discharge said stack of coins out of said stacking cylinder.

5. A device for detecting a stack of coins for use in a coin-packaging machine of claim 1, wherein, when said relay is energized to produce an output, the coins-packaging machine is reset to the initial condition of its cyclic operation.

* * * * *